US010449682B2

(12) United States Patent
Eijkelkamp et al.

(10) Patent No.: US 10,449,682 B2
(45) Date of Patent: Oct. 22, 2019

(54) COUPLING MECHANISM FOR A DRIVE TRAIN OF A HAIR CUTTING APPLIANCE

(71) Applicant: KONINKLIJKE PHILIPS N.V., Eindhoven (NL)

(72) Inventors: Marcus Franciscus Eijkelkamp, Eindhoven (NL); Johannes Willem Tack, Eindhoven (NL); Geert Willem De Goeij, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/550,451

(22) PCT Filed: Dec. 22, 2016

(86) PCT No.: PCT/EP2016/082500

§ 371 (c)(1),
(2) Date: Aug. 11, 2017

(87) PCT Pub. No.: WO2017/109143

PCT Pub. Date: Jun. 29, 2017

(65) Prior Publication Data

US 2018/0281213 A1 Oct. 4, 2018

(30) Foreign Application Priority Data

Dec. 22, 2015 (EP) ..... 15202049

(51) Int. Cl.

| | |
|---|---|
| ***B26B 19/28*** | (2006.01) |
| ***B26B 19/06*** | (2006.01) |
| ***B26B 19/38*** | (2006.01) |

(52) U.S. Cl.

CPC ..... *B26B 19/28* (2013.01); *B26B 19/063* (2013.01); *B26B 19/386* (2013.01)

(58) Field of Classification Search

CPC ..... B26B 19/02; B26B 19/046; B26B 19/28; B26B 19/06; B26B 19/14; B26B 19/145; B26B 19/386; B26B 19/063

(Continued)

(56) References Cited

U.S. PATENT DOCUMENTS 3,894,297 A 7/1975 Mittelmeier
4,482,336 A 11/1984 Orain (Continued)

FOREIGN PATENT DOCUMENTS

CA 2386694 A1 * 11/2002 ..... B26B 19/141
CA 2465591 A1 * 11/2004 ..... B26B 19/14

(Continued)

OTHER PUBLICATIONS

English Translation of JP06-182065A (Year: 1994).*

*Primary Examiner* — Jennifer B Swinney

(57) ABSTRACT

A self-aligning coupling linkage for a drive train, of a hair cutting appliance having a driving shaft and a non-aligning output shaft, includes a joint section having first and second connector portions that are configured to engage one another for torque transmission. The first second connector portions define a male connector having an external polygonal profile, viewed in a cross-sectional plane perpendicular to a longitudinal axis, and a female connector having an internal engagement profile. The male and female connectors are arranged in a self-aligning fashion for angular offset compensation, where wherein at least one of the male and female connectors is provided with at least one circumferentially arranged deflectable compensation element configured to urge the male and female connectors towards a centered alignment.

19 Claims, 5 Drawing Sheets

(58) Field of Classification Search
USPC ..... 30/43.4, 43.5, 43.91, 43.92
See application file for complete search history.

(56) References Cited

U.S. PATENT DOCUMENTS

| | | | | | |
|---|---|---|---|---|---|
| 4,631,825 | A | * | 12/1986 | Kuriyama | B26B 19/04 30/34.1 |
| 5,730,657 | A | | 3/1998 | Olgren | |
| 7,530,171 | B2 | * | 5/2009 | Baron | B26B 19/14 30/205 |
| 2003/0019107 | A1 | | 1/2003 | Visman | |
| 2006/0240896 | A1 | | 10/2006 | Ohashi | |
| 2008/0287201 | A1 | | 11/2008 | Oh | |
| 2011/0281659 | A1 | | 11/2011 | Yamashita | |

FOREIGN PATENT DOCUMENTS

| | | | | |
|---|---|---|---|---|
| EP | 2123408 | A1 | | 11/2009 |
| GB | 148251 | A | | 6/1921 |
| JP | 06182065 | A | * | 7/1994 |
| WO | 03011537 | A1 | | 2/2003 |
| WO | 2013021306 | A1 | | 2/2013 |
| WO | 2015158681 | A1 | | 10/2015 |

* cited by examiner

COUPLING MECHANISM FOR A DRIVE TRAIN OF A HAIR CUTTING APPLIANCE

This application is the U.S. National Phase application under 35 U.S.C. § 371 of International Application No. PCT/EP2016/082500, filed on Dec. 22, 2016, which claims the benefit of International Application No. 15202049.1 filed on Dec. 22, 2015. These applications are hereby incorporated by reference herein.

FIELD OF THE INVENTION

The present disclosure relates to a hair cutting appliance, particularly to an electrically operated hair cutting appliance, and more particularly to a coupling linkage mechanism for a drive train of a hair cutting appliance which is arranged to compensate an angular offset between a driving shaft and a non-aligning output shaft which is arranged at an angular offset with respect to the driving shaft.

BACKGROUND OF THE INVENTION

WO 2015/158681 A1 discloses a hair cutting appliance, particularly an electrically operable hair cutting appliance, said hair cutting appliance comprising a housing, a cutting head attached to said housing, and a drive train comprising a driving shaft, an output shaft and a coupling linkage, said coupling linkage comprising a driving shaft and a non-aligning output shaft, said coupling linkage comprising a first driving coupling element arranged to be driven by a driving shaft, particularly by a motor shaft, a transmission shaft, particularly a rigid transmission shaft, comprising a first driveable coupling element at a first end and a second driving coupling element at a second end thereof, wherein the first driving coupling element engages the first driveable coupling element for rotatingly driving the transmission shaft, thereby forming a first pivoting joint, wherein the second driving coupling element is arranged to engage a second driveable coupling element of an output shaft, wherein the first driving coupling element and the first driveable coupling element define a male connector comprising an external polygonal profile, viewed in a cross-sectional plane perpendicular to a longitudinal axis, and a female connector comprising an internal polygonal profile, and wherein the external polygonal profile of the male connector, viewed in a longitudinal axial section, is at least sectionally provided with convexly shaped flanks.

In accordance with the arrangement described in WO 2015/158681 A1 a drive train for a hair cutting appliance is provided which is suitable for curved or banana-shaped casings and housings. Consequently, an easy-to-handle appliance may be provided which facilitates operating the appliance which may be beneficial in shaving applications and trimming applications.

In one embodiment, the above WO 2015/158681 A1 relates to a blade set for a cutting head for a hair cutting appliance, wherein the blade set comprises a stationary blade and a moveable blade (cutter) which is arranged to be reciprocatingly moved with respect to the stationary blade. Further, a swiveling mechanism is provided which improves the appliance's ability to follow a skin contour.

Since the blade set including the stationary blade and the cutter is arranged in a pivotable fashion, and since the housing of the appliance is preferably arranged in an elongated but also curved fashion, an angular offset between a motor and an output shaft of the involved drive train is present. For compensating the angular offset, a coupling linkage is presented which comprises at least one transmission joint involving a male part and a female part which are arranged to engage one another, wherein the male part and the female part are provided with polygonal profiles at least one of which is provided with convexly shaped flanks. Consequently, an angular offset between the male part and the female part may be compensated.

The above WO 2015/158681 A1 already provides for a reliable and relatively simple design for an angular offset self-aligning coupling linkage. However, there is still a need for improvement in hair cutting appliances including respective drive trains for angular offset compensation. This may particularly involve user comfort related aspects and performance related aspects. One involved aspect is noise emission. A further involved aspect is vibration emission. Further, it has been observed that, in certain applications, respective driving joints of angular offset compensation drive trains are prone to wear, depending on actual tolerance conditions. If only tight fit or press fit tolerances are present, there is a certain risk of heat generation and related wear. In case too much play is provided and large clearances are present between mating parts, an increase of the noise level may result. This may pose further challenges to the drive train design for hair cutting appliances.

SUMMARY OF THE INVENTION

It is therefore an object of the present disclosure to provide a drive train, particularly a coupling linkage for a drive train of a hair cutting appliance that may enhance the operating performance of the appliance and contributes to a pleasant user experience. Furthermore, it is desired to provide a hair cutting appliance fitted with a respective drive train. It is particularly desired that the drive train enables hair cutting operation at a significantly reduced noise and/or vibration level. More particularly, it is desired that the drive train is arranged in a hard-wearing fashion. It would be further preferred to diminish unpleasant emissions that may emerge from a drive train, for instance running noises and vibration emissions. Preferably, the drive train, particularly the coupling linkage thereof is arranged for angular offset compensation. Furthermore, the coupling linkage is preferably easy-to-assemble and easy-to-manufacture.

In a first aspect of the present invention a self-aligning coupling linkage for a drive train of a hair cutting appliance comprising a driving shaft and a non-aligning output shaft is presented, said coupling linkage comprising a joint section comprising a first connector portion and a second connector portion that are arranged to engage one another for torque transmission, wherein the first connector portion and the second connector portion define a male connector comprising an external polygonal profile, viewed in a cross-sectional plane perpendicular to a longitudinal axis, and a female connector comprising an internal engagement profile, wherein the male connector and the female connector are arranged in a self-aligning fashion for angular offset compensation, and wherein at least one of the male connector and the female connector is provided with at least one circumferentially arranged deflectable compensation element arranged to urge the male connector and the female connector towards an operating alignment.

This aspect is based on the insight that angular offset compensation often requires involved mating elements to be provided with considerable assembly play and/or engagement play. When a defined torque is applied to a respective self-aligning joint, assuming that a relatively steady operation can be achieved, defined contact conditions may be achieved which would basically involve limited noise and vibration emission. However, when no steady load is applied, for instance when starting up a motor of the drive train and/or when uneven/unsteady operating conditions are present, the drive train may emit considerably large vibrations and a certain noise level. This may be the case when the required level of cutting power is not constant. Further, poor true-running conditions may involve static or dynamic unbalances which may effect an increased vibration and/or noise level. In some configurations, unsteady operation conditions typically occur in a torque range between at least 0.0 mNm and 0.4 mNm (millinewtonmeter). Hence, as only a slight preloading is present, conventional joints may exhibit rattling noises.

In conventional self-adjusting drive trains, further functional impairments may result from play between involved parts, e.g. due to manufacturing and/or assembly tolerances as such, a level of the applied torque load, and/or geometrical differences at different driving angles between involved components.

As used herein, the term operating alignment relates, at least in some embodiments, to a centered alignment, but not to a parallel alignment or even a coaxial alignment of the involved shaft parts. Rather, the joint section is arranged to compensate a present angular offset between the involved shafts. Consequently, a centered alignment basically relates to an arrangement wherein a certain element or point of one involved connector is positioned at or at least in a defined proximity of the longitudinal axis of the mating connector. Nevertheless, at least in some embodiments, the coupling linkage may be arranged for offset compensation and/or for compensating skewed shafts. To this end, two respective joints may be provided which couple an arrangement of three shafts involving the driving shaft, the output shaft and a transmission shaft arranged therebetween.

As used herein, the coupling linkage may be also referred to as balancing coupling linkage or compensating coupling linkage. In exemplary embodiments, the coupling linkage is arranged as a two stage coupling linkage which involves three shafts each of which is arranged in an inclined (angular offset) fashion with respect one or two neighboring shafts. Each stage of the two stage coupling linkage may involve a respective compensation joint between two neighboring shafts that are coupled by the compensation joint.

In accordance with the above aspect, the male connector and the female connector of the joint section are arranged in a basically free-of-played fashion. However, since the compensation element is at least partially deflectable, the angular offset compensation capability is maintained. The first connector portion and the second connector portion form the male connector and the female connector. I.e., one of the first connector portion and the second connector portion forms the male connector and the other one of the first connector portion and the second connector portion forms the female connector.

Consequently, at least in some embodiments, the male connector and the female connector engage one another in a floating fashion. While it is intended that longitudinal axes of the involved male connector and female connector intersect one another, preferably at a certain defined point of within a defined range, there may be deviations from the intended relative coupling position.

In one embodiment of the coupling linkage, a plurality of circumferentially arranged deflectable compensation elements is provided, wherein preferably three deflectable compensation elements are provided, and wherein the compensation elements are arranged to apply a centering compensation force to the male connector and the female connector. The compensation elements may be evenly distributed at the circumference of either the male connector or the female connector. In case three or more compensation elements are provided, a self-centering alignment may be achieved more easily.

In yet another embodiment of the coupling linkage, the at least one compensation element is an integrally formed biasing element arranged at one of the male connector and the female connector. When the at least one compensation element is provided at the female connector, a basically inwardly acting biasing force may urge the male connector and the female connector into the desired relative orientation. When the at least one compensation element is arranged at the male connector, a basically outwardly directed force may urge the male connector and the female connector into the desired alignment and/or orientation.

An integrally formed arrangement is easy-to-manufacture and requires no additional or only relatively little manufacturing efforts. In one embodiment, the male connector and the female connector may be assembled to one another in a snap-on or click-on fashion. However, in alternative embodiments, the male connector and the female connector may be simply inserted into one another. This may involve that no locking feature at the level of the joint is present. Rather, the drive train as such can be arranged at the appliance in a defined manner. At least one involved connector may be arranged as an integrally shaped injection-molded plastic connector.

Preferably, the at least one compensation element may exert a force on the joint section which maintains the engagement state of the male connector and the female connector. Consequently, the compensation element may further act as a loss-proof or loss-prevention element. This may further simplify the manufacturing process.

Preferably, no additional mating element is required at the joint section to establish the joint between the male connector and the female connector.

In yet another embodiment of the coupling linkage, the at least one compensation element comprises a stem portion extending from a base and a deflectable arm portion, wherein the arm portion comprises a contact surface. Via the contact surface, the centering force may be applied to the mating connector. The at least one compensation element may also be referred to as compensation tab.

In a further refinement of the above embodiment, the stem portion is fixedly attached to an axial connecting wall of one of the male connector and the female connector, wherein the arm portion is outwardly and inwardly deflectable. The arm portion is basically radially deflectable. Hence, the contact surface of the arm portion may approach a center and/or may be removed from the center when the compensation element is deflected.

In yet another refinement of the coupling linkage, the at least one compensation element is arranged to flex in such a way that a resulting deflection axis is basically perpendicular to a connector longitudinal axis. Consequently, a main elongation direction of the compensation element is basically parallel to the longitudinal axis. The at least one compensation element may form a living hinge. The axial wall forms part of the connector (male connector or female connector) from which the compensation element extends. Needless to say, the compensation element may be arranged to flex in a cantilever fashion. Consequently, there is no steady deflection axis but rather an instantaneous deflection axis may be defined.

In another embodiment of the coupling linkage, the stem portion is fixedly attached to a circumferential connecting wall of one of the male connector and the female connector, wherein the arm portion is outwardly and inwardly deflectable. This may involve that a main extension direction of the compensation element is in or proximate to the circumferential direction (e.g. a tangent line). Consequently, in accordance with at least some embodiments, there is no axial but rather a circumferential connection between the compensation element and the associated connector.

In one refinement of the above embodiment, the compensation element basically extends in a circumferential direction from the circumferential connecting wall, wherein the circumferential direction corresponds to an operational rotation direction of the drive train. As used herein, the term circumferential direction does not necessarily relates to a perfect circle. Rather, the circumferential connecting wall generally has a cross-section which is not perfectly circular or annular.

However, also in the arrangement in accordance with the above embodiment, the contact surface of the compensation element may be inwardly and/or outwardly moved when the compensation element is deflected.

In still another refinement of the above embodiment, the at least one compensation element is arranged to flex in such a way that a resulting deflection axis is basically parallel to a connector longitudinal axis. As already indicated above, the resulting deflection axis may be an instantaneous imaginary axis as the compensation element may be deflected in a cantilever fashion.

In a further exemplary embodiment, the at least one compensation element is arranged as a spring, particularly a metal spring. The metal spring may be arranged as a flexing flat spring, for instance. In accordance with this embodiment, the at least one compensation element may be an additional part which may be attached to the male connector or the female connector so as to bias the respective counterpart in the engaged state of the joint. For instance, the metal spring may be a metal insert which may be fixedly coupled to one of the male connector and the female connector when the connector is formed, e.g. injection-molded.

In yet another embodiment of the coupling linkage, the internal engagement profile of the female connector is arranged in a partially recessed pattern, wherein the at least one compensation element is arranged at a wall recess of the internal engagement profile, and wherein the at least one compensation element is arranged to contact the external polygonal profile of the male connector so as to apply an inwardly directed force on the external polygonal profile.

In an alternative embodiment, the external polygonal profile of the male connector is arranged in a partially recessed pattern, wherein the at least one compensation element is arranged at a wall recess of the external polygonal profile, and wherein the at least one compensation element is arranged to contact the internal engagement profile of the female connector so as to apply an outwardly directed force on the external polygonal profile.

Needless to say, further embodiments may be envisaged which involve compensation elements at both the external polygonal profile of the male connector and the internal engagement profile of the female connector.

In yet another embodiment of the coupling linkage, the at least one compensation element, in the mounted state, contacts a contact surface of the external polygonal profile of the male connector so as to exert a force on the male connector such that a driving surface of the external polygonal profile which is opposite or adjacent to the contact surface is urged into close contact with a corresponding mating driveable flank of the internal engagement profile of the female connector.

In yet another embodiment of the coupling linkage, a plurality of compensation elements is provided, wherein the male connector and the female connector engage one another in a preloaded fashion. Preferably, the male connector and the female connector engage one another in a self-centered fashion. A relatively low bias or preloading is required for sufficiently reduce the noise level and/or the vibration level of the drive train. Assuming that an angular offset is present between the male connector and the female connector, a more or less constant (axial) sliding movement between involved contact surfaces is present when a rotational movement is transferred via the respective joint. It is therefore preferred that only a limited preloading is present so as to avoid heat generation and associated operation impairments (huge friction, etc.). Consequently, excessive power consumption and an unpleasant temperature increase may be avoided. For instance, the preload level may be in the range of 0.1 N (Newton) to 1.0 N, preferably in the range of about 0.15 N to about 0.3 N, when the compensation elements and the neighboring assembly parts are in an aged state. So as to achieve the preloaded between the male connector and the female connector, the compensation elements may be formed in such a way that the male connector and the female connector may be attached to one another in an at least slight press-fit fashion.

At least in some embodiments in accordance with the present disclosure, the need of grease or a similar lubricant may be dispensed with. Nevertheless, in some embodiments, grease or another appropriate lubricant may be added so as to avoid excessive wear, and to reduce friction related to the relative sliding motion between the involved components. At least a reduced amount of grease or another suitable lubricant is required to achieve a smooth running performance. The less lubricant is used, the better the drive train can sustain wet cleansing. Further, the less lubricant is used, the fewer dirt and debris may adhere or stick to the drive train.

It is therefore preferred that the joint section, preferably, the whole coupling linkage is arranged in a lubrication-free or grease-free fashion. In other words, the joint section and the coupling linkage involving the joint section may be arranged in a dry-running fashion.

In yet another embodiment of the coupling linkage, a further joint section is provided, wherein a first joint (defined by the first joint section) is arranged between the driving shaft and a transmission shaft, wherein the further joint section defines a second joint arranged between the transmission shaft and the output shaft, wherein the second joint comprises a first connector portion and a second connector portion of the second joint that are arranged to engage one another for torque transmission, wherein the first connector portion and the second connector portion define a male connector comprising an external polygonal profile, viewed in a cross-sectional plane perpendicular to a longitudinal axis, and a female connector comprising an internal polygonal profile, and wherein the male connector and the female connector are arranged in a self-aligning fashion for angular offset compensation.

In this way, the coupling linkage may be arranged for angular compensation, but also (in addition or in the alternative) for offset compensation between the driving shaft and the output shaft. The driving shaft and the output shaft may be arranged at an angular offset, at a parallel offset, generally spaced from one another, but also arranged in a skewed orientation with respect to one another. With respect to the transmission shaft, the driving shaft and the output shaft may point to the same direction (half space), but may also point to different directions (half spaces).

Further, the coupling linkage may be arranged for length compensation, when at least one joint therefor enables a defined axial movement of the involved joints, e.g. an allowed overall length deviation is 3.0 mm (millimeter), preferably 6.0 mm. This may be beneficial when the hair cutting appliance includes a swiveling arrangement for the cutting head. Further, axial manufacturing and/or assembly tolerances may be compensated.

In accordance with the above embodiment, two compensation joints are provided which improves the ability of the coupling linkage to compensate even larger angular offsets. For instance, an overall offset δ (delta) between the driving shaft and the output shaft may be split into two partial offset angles α (alpha) and β (beta), wherein the first joint handles the offset angle α, and wherein the second joint handles the offset angle β. Consequently, an even further convex shape of the hair cutting appliance may be provided. Needless to say, one or both of the joints may be arranged in accordance with the above-described embodiments and aspects.

The overall offset angle δ may be generally between 0° and 60° (degrees). Further, also the partial offset angles α and β may be generally in the range between 0° and 60°. In some embodiments, the partial offset angles α and β may be generally between 0° and 30°, wherein a sum of α and β corresponds to δ. Consequently, the partial offset angles α and β may be arranged in a common plane, but may be also arranged in separate planes which are inclined with respect to one another. Further, when the partial offset angles α and β are arranged in an opposite fashion with respect to a common leg thereof, the overall offset angle δ may correspond to the difference between the absolute values of the angles α and β.

In another aspect of the present disclosure a hair cutting appliance, particularly an electrically operable hair cutting appliance, is presented said hair cutting appliance comprising a housing, a cutting head attached to said housing, and a drive train comprising a driving shaft, an output shaft and a coupling linkage in accordance with at least one embodiment as described herein, wherein the cutting head comprises a blade set, and wherein the drive train is arranged to actuate the blade set when the cutting head is attached to the housing.

Typically, the blade set involves a moveable cutter blade and a stationary blade, wherein the moveable cutter blade is moveable with respect to the stationary blade, and wherein the drive train is arranged to actuate the moveable cutter blade when the cutting head is attached to the housing. Upon a reciprocating relative movement between the moveable cutter blade and the stationary blade, the hair cutting action may be effected.

The blade set may be arranged as a releasable blade set which may be arranged at or attached to the appliance in a click-on or snap-on fashion. Further, the blade set may be arranged to cooperate with an attachment comb which may be provided as an add-on component of the hair cutting appliance. With respect to an exemplary design of the blade set, again reference is made to WO 2015/158681 A1.

In one exemplary embodiment, the hair cutting appliance further comprises a main body portion formed by the housing, and a neck portion, wherein the main body portion houses a motor, wherein the blade set is attached to the neck portion, preferably in a pivotable fashion, wherein the neck portion is oriented at an angular offset with respect to a main orientation of the main body portion, wherein the main body portion houses the driving shaft, wherein the neck portion houses the output shaft, wherein the driving shaft and the output shaft are arranged at an overall offset angle δ, wherein the transmission shaft of the coupling linkage couples the driving shaft and the output shaft, wherein the transmission shaft is arranged at a partial offset angle β with respect to the output shaft, and wherein the transmission shaft is arranged at a partial offset angle α with respect to the driving shaft. In one embodiment, the offset angles α and β are basically similar in size.

BRIEF DESCRIPTION OF THE DRAWINGS

These and other aspects of the invention will be apparent from and elucidated with reference to the embodiments described hereinafter. In the following drawings

DETAILED DESCRIPTION OF THE EMBODIMENTS

Figure 1:
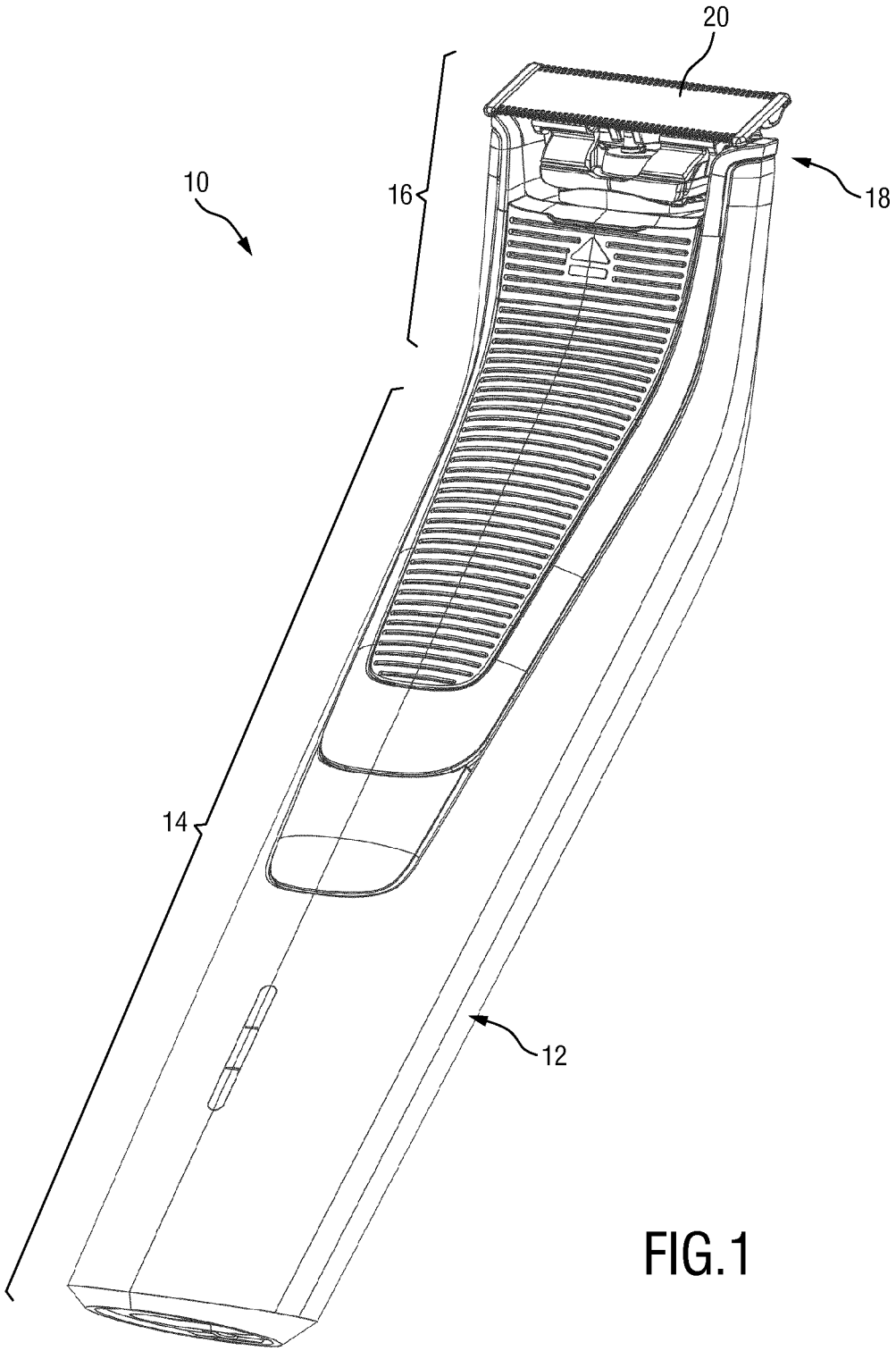
FIG. 1 shows a schematic perspective view of an exemplary electric hair cutting appliance comprising a cutting head.

FIG. 1 schematically illustrates a hair cutting appliance 10, particularly an electric hair cutting appliance 10. The hair cutting appliance 10 in accordance with FIG. 1 includes a housing 12 which is arranged to house a motor for driving the hair cutting appliance 10. The housing 12 may further house a battery, for instance a rechargeable battery. However, in some embodiments, the hair cutting appliance 10 may be provided with a power cable for connecting a power supply. A power supply connector may be provided in addition or in the alternative to an (internal) electric battery. The housing 12 may further comprise operator controls, for instance switches, buttons, LEDs, and such like.

As indicated in FIG. 1 by brackets (reference numerals 14, 16), the housing 12 may comprise a main portion 14 and a neck portion 16. Further, a cutting head 18 is provided which is associated to the neck portion 16, at least in the mounted state. As shown in FIG. 1 in an illustrative, non-limiting embodiment, the housing 12 may comprise a generally elongated shape which is, however, somewhat curved or banana-shaped. In other words, a main elongation direction of the neck portion 16 may be somewhat different from or inclined with respect to a main elongation direction of the main portion 14.

Figure 2:
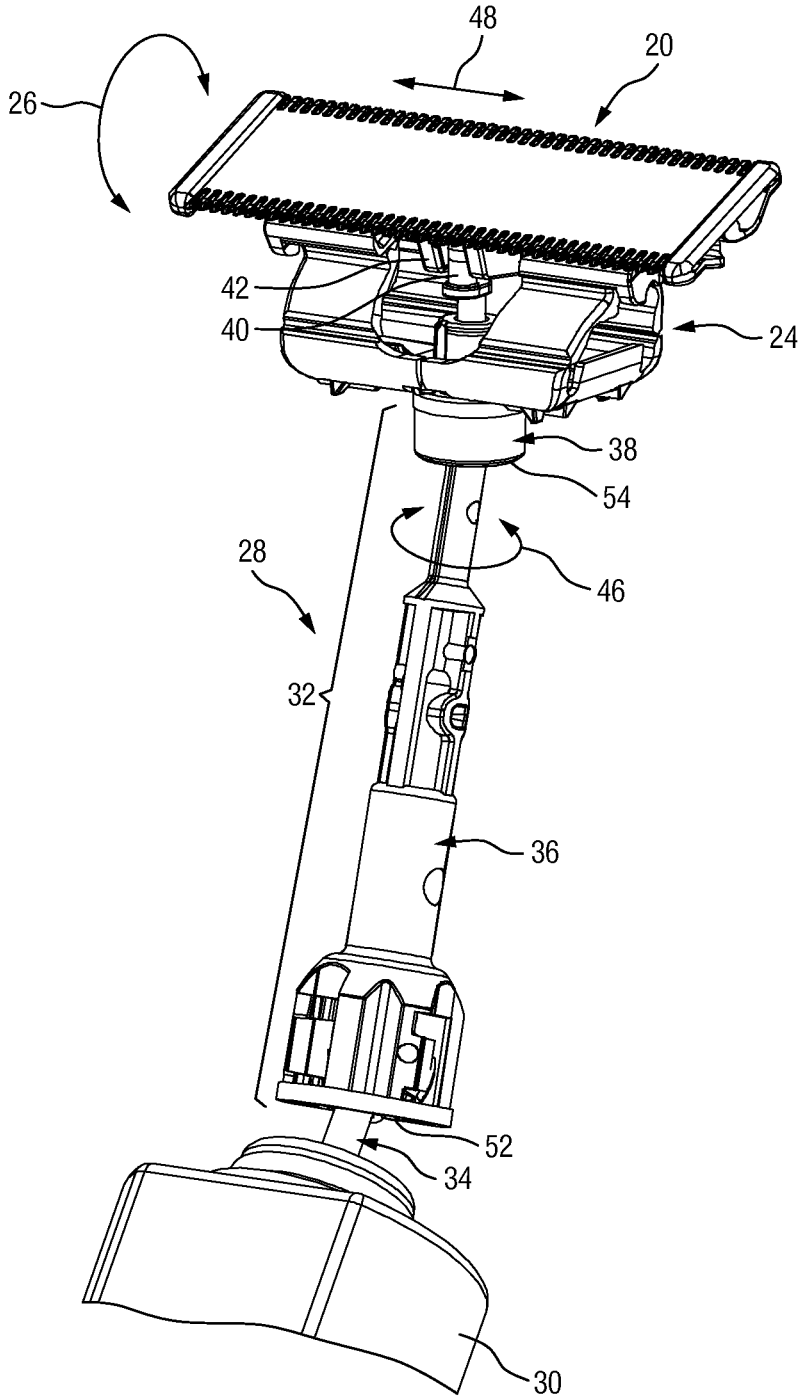
FIG. 2 is a perspective view of a drive train for a hair cutting appliance, wherein the drive train is arranged between a motor and a blade set.

Further, reference is made to FIG. 2 illustrating an exemplary enlarged partial view of an internal arrangement of the hair cutting appliance 10 as illustrated in FIG. 1. In FIG. 2 the housing 12 is omitted. The cutting head 18 includes a blade set 20. The blade set 20 may be arranged as a replaceable or detachable blade set 20 which is arranged to be attached to the cutting head 18 and, consequently, to the housing 12 in a snap-on or click-on fashion.

Typically, the blade set 20 comprises a stationary blade and a moveable cutter blade which are arranged to be moved with respect to one another so as to cut hair. A detailed embodiment of a blade set 20 which may be attached to the hair cutting appliance 10 is described in WO 2015/158681 A1. Further, an attachment comb (not shown in FIG. 1) may be attached to the housing 12 in the vicinity of or adjacent to the cutting head 18. The attachment comb may set a defined offset between the skin and the blade set 20 when trimming hair to a desired length (e.g., 3 mm (millimeters), 6 mm, 9 mm, etc.). Without the attachment comb, the appliance 10 is arranged for cutting or chopping hair close to the skin, i.e. for shaving and for contouring/styling operations.

Accordingly, the blade set 20 may be provided with a double-wall stationary blade comprising a top wall and a bottom wall, wherein a guide slot is defined between the top wall and the bottom wall of the stationary blade, and wherein the moveable cutter blade is moveably received in the guide slot. Hence, the stationary blade encircles or embraces the moveable cutter blade. Teeth of the stationary blade embrace or guard teeth of the moveable cutter blade. As shown in FIGS. 1 and 2, the blade set 20 is basically arranged in a linear fashion. Hence, relative movement between the stationary blade and the moveable cutter blade typically involves a reciprocating longitudinal movement. Preferably, the blade set 20 comprises a first leading edge and a second leading edge which may be arranged in a fashion parallel to one another. This basically enables a to and fro movement (including push and pull strokes) action. The leading edges are defined by a plurality of stationary blade teeth and movable cutter blade teeth. However, alternative embodiments of the blade set 20 may be envisaged which involve a relative rotational or oscillatory movement between the stationary blade and moveable cutter blade. In these alternative embodiments, the stationary blade and moveable cutter blade may be at least partially shaped in a circular fashion.

Again, reference is made to FIG. 2. The blade set 20 is coupled with the cutting head 18 (FIG. 1) via a swivel mechanism 24. By way of example, the swivel mechanism 24 may be arranged as a four-bar mechanism defining a virtual pivot for the blade set 20. Due to the swivel mechanism 24 as exemplarily shown in FIG. 2, the hair cutting appliance 10 may provide an improved contour following capability when the blade set is guided through hair while in close contact with the skin, at least in some embodiments. A swiveling movement of the blade set 20 is indicated by a curved double-arrow 26 in FIG. 2. An attachment comb, if provided, may be arranged to block or lock the swiveling mechanism 24 which may be advantageous for hair trimming application.

FIG. 2 further exemplifies a drive train 28 of the hair cutting appliance 10. The drive train 28 is arranged between a motor 30 and the cutting head 18 to which the blade set 20 may be attached. Further, FIG. 2 shows that, at least in some embodiments, a considerable angular offset may be present at the drive train 28 of a hair cutting appliance. This is, to some extent, attributable to the desired curved design of the housing 12 which may improve handling the hair cutting appliance 10. By way of example, the motor 30 may be arranged in the main portion 14 of the housing 12, refer to FIG. 1.

By contrast, the cutting head 18 including the blade set 20 which is attached to the swivel mechanism 24 is arranged at the neck portion 16. Consequently, the drive train 28 is arranged as an angular offset compensating drive train. The drive train 28 includes a coupling linkage 32 which extends between the motor 30 and the blade set 20 to actuate the moveable blade thereof. The coupling linkage 32 is arranged as a two-stage or two-joint coupling linkage 32.

Further, a driving shaft 34, a transmission shaft 36 and an output shaft 38 form part of the drive train 28. The transmission shaft 36 is arranged between the driving shaft 34 and the output shaft 38. The driving shaft 34 is coupled to the motor 30. The driving shaft 34 may be also referred to as output shaft of the motor 30. The driving shaft 34 engages and drives the transmission shaft 36. The transmission shaft 36 engages and drives the output shaft 38. The output shaft 38 is arranged to engage and drive the moveable cutter blade for relative movement with respect to the stationary blade. To this end, an eccentric driver 40 is provided at the output shaft 38 (refer also to FIG. 5). The eccentric driver 40 is arranged to contact and engage an engagement portion 42 which forms part of or is coupled with the moveable cutter blade of the blade set 20 for reciprocating entrainment.

A general direction of rotation of the drive train 28 is indicated in FIG. 2 by an arrow 46. A reciprocating translation (here: linear movement) of the blade set 20, particularly the moveable cutter blade thereof (not explicitly shown in FIG. 2), is indicated by a double arrow 48 in FIG. 2.

As can be further seen in FIG. 2, even when the blade set 20 is swiveled (curved double arrow 26), the eccentric driver 40 of the output shaft 38 may maintain its driving engagement with the engagement portion 42.

In one exemplary embodiment, the coupling linkage 32 of the drive train 28 includes a first joint section (hereinafter first joint) 52 and a second joint section (hereinafter second joint) 54. The first joint 52 is arranged between the driving shaft 34 and the transmission shaft 36. The second joint 54 is arranged between the transmission shaft 36 and the output shaft 38. Each of the first joint 52 and the second joint 54 involves an engagement contour (mating internal and external profiles) for rotation transfer and/or torque transfer between the motor 30 and the output shaft 38.

Figure 3:
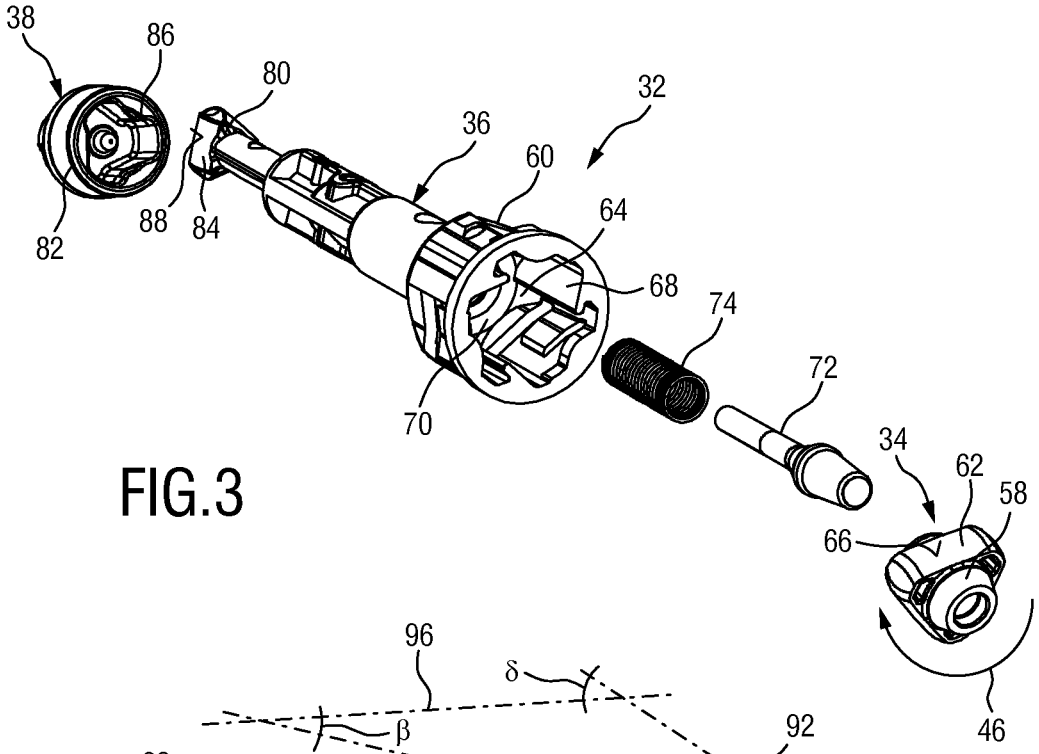
FIG. 3 is a perspective exploded rear view of a coupling linkage for a drive train as shown in FIG. 2.
Figure 4:
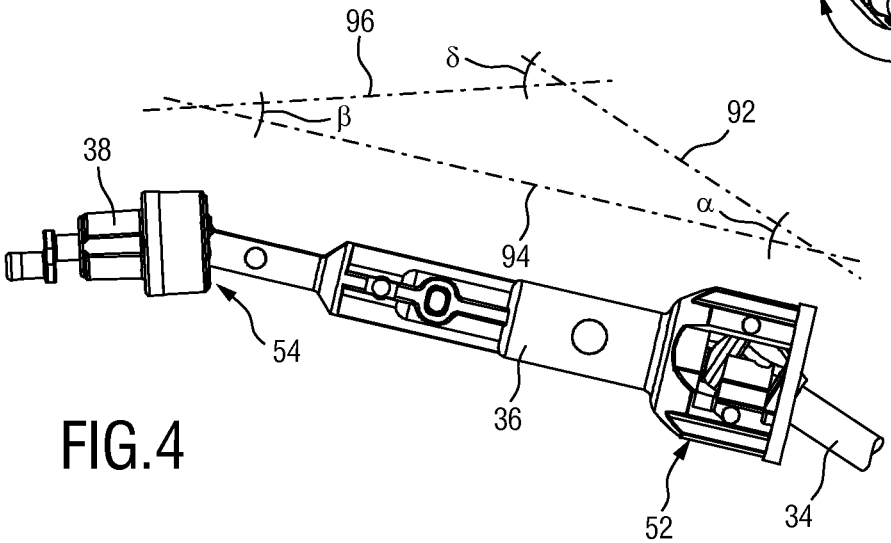
FIG. 4 is a side view of the coupling linkage as shown in FIG. 3, in an assembled state.
Figure 5:
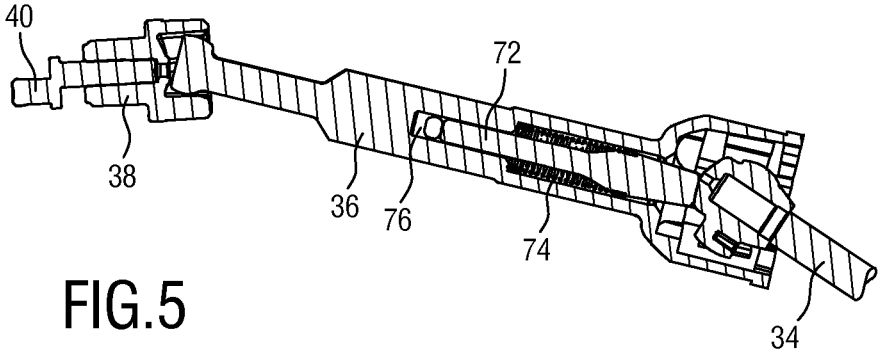
FIG. 5 is a cross-sectional side view of the arrangement of FIG. 4.

Further reference is made to FIGS. 3 to 5. FIG. 3 shows an exploded perspective rear view of the coupling linkage 32. FIG. 4 and FIG. 5 show corresponding side views, wherein FIG. 5 is a cross-sectional side view. As indicated above, the coupling linkage 32 extends from the driving shaft 34 over the transmission shaft 36 to the output shaft 38.

The first joint 52 includes a first connector portion which will be referred to hereinafter as male connector 58, and a second connector portion which will be referred to hereinafter as female connector 60. The male connector 58 comprises an external polygonal profile 62. The female connector 60 comprises an internal engagement profile 64. The external polygonal profile 62 of the male connector 58 is arranged in a basically triangular fashion. Further, the external polygonal profile 62 of the male connector 58 comprises an arrangement of convexly shaped flanks 66. The male connector 58 is attached to or integrally shaped with the driving shaft 34.

The female connector 60 is attached to or integrally shaped with the transmission shaft 36. At the counterpart female connector 60, the internal engagement profile 64 of the female connector 60 is provided with engagement bars 68 which form drivable flanks 70. Needless to say, the engagement bars 68 do not necessarily have to be arranged as bars, ribs, or tabs. Rather, another suitable internal engagement profile 64 forming the drivable flanks 70 may be provided. The external polygonal profile 62 of the male connector 58 is arranged to contact and transmit a driving force on the drivable flanks 70. Consequently, a rotational movement of the male connector 58 (refer to the arrow 46 in FIG. 3) is translated in a corresponding rotational movement of the transmission shaft 36. In the embodiment illustrated in FIG. 3 the driving rotation direction is basically clockwise which, however, shall not be understood in a limiting sense. As a result of the design of the male connector 58 and the female connector 60, an angular offset (angle $\alpha$) may be compensated, refer also to the side view of FIG. 4.

In one exemplary embodiment, the transmission shaft 36 houses a push rod 72 which cooperates with a biasing element 74. The push rod 72 and the biasing element 74 are arranged in a basically longitudinally extending receiving recess 76 at the transmission shaft 36, refer also to FIG. 5. The biasing element 74 is arranged as a coil spring or helical spring. The biasing element 74 urges the push rod 72 against the driving shaft 34. This may reduce axial play of the drive train 28 or the coupling linkage 32. Further, the biasing element 74 simplifies assembling the drive train 28 as the involved components may be automatically urged into the desired engagement. The biasing element 74 may also contribute to axial length (axial offset) compensation.

Again, reference is made to FIG. 3. Between the transmission shaft 36 and the output shaft 38, the second joint 54 is provided, refer also to FIG. 4. The second joint 54 comprises a first connector portion which will be hereinafter referred to as male connector 80. Further, a second connector portion is provided which will be further referred to as female connector 82. The male connector 80 is attached to or integrally shaped with the transmission shaft 36. The male connector 80 comprises an external polygonal profile 84. The external polygonal profile 84 may be arranged in a triangular fashion.

The female connector 82 is attached to or integrally formed with the output shaft 38. The female connector 82 comprises an internal polygonal profile 86 which may basically form a negative of an outer contour (cross-sectional silhouette) of the external polygonal profile 84. The external polygonal profile 84 of the male connector 80 engages the internal polygonal profile 86 of the female connector 82 so as to transfer a rotational movement and/or torque from the transmission shaft 36 to the output shaft 38. Since also the external polygonal profile 84 of the male connector 80 is at least partially provided with convex flanks 88, a force transmission and an entrainment of the output shaft 38 is enabled even if an angular offset (angle $\beta$) between the transmission shaft 36 and the output shaft 38 is present.

Again, reference is made to FIG. 4. In FIG. 4, longitudinal axes of the driving shaft 34, the transmission shaft 36 and the output shaft 38 are indicated by reference numerals 92, 94 and 96, respectively. As can be further seen, a partial offset angle $\alpha$ (alpha) is present between the longitudinal axes 92, 94 of the transmission shaft 36 and the driving shaft 34. Further, another partial angular offset $\beta$ (beta) is present between the transmission shaft 36 and the output shaft 38. Further, an overall angular offset $\delta$ (delta) is indicated in FIG. 4 between the axes 92, 96. Consequently, a relatively large angular offset between the driving shaft 34 and the output shaft 38 has to be overcome by the drive train 28, particularly the coupling linkage 32 thereof. The partial angular offsets $\alpha$ and $\beta$ may involve similar angle values the sum of which corresponds to the overall angular offset $\delta$. The involved angles $\alpha$, $\beta$ and $\delta$ may be generally in the range between 0° and 60° (degrees), wherein it is preferred that $\alpha+\beta=\delta$, provided that the angles are arranged in a common plane.

In the following, exemplary embodiments of the first joint 52, particularly of the male connector 58 and the female connector 60 thereof, will be further detailed and described. It is noted that also the second joint 54, while not shown in FIG. 3 in a respective arrangement, may be formed in accordance with the following embodiments. In the alternative, the second joint 54 may be formed in accordance with one of the following embodiments while the first joint 52 is arranged in accordance with the exemplary embodiment of the second joint 54 illustrated in FIG. 2. Hence, also the first joint 52 may be basically arranged in accordance with the general design of the second joint 54 as shown in FIG. 3. However, it is preferred that at least one of the first joint 52 and the second joint 54 is arranged in accordance with an exemplary arrangement as described hereinafter.

Figure 6:
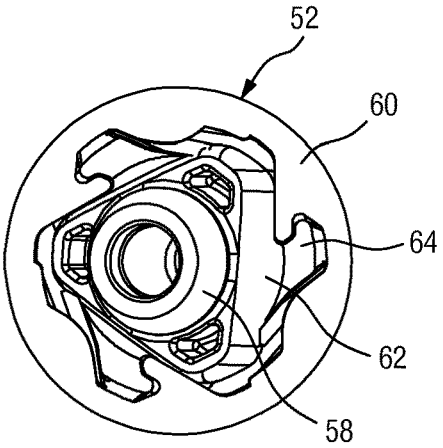
FIG. 6 is a rear view of a first joint section including a male connector and a female connector.
Figure 7:
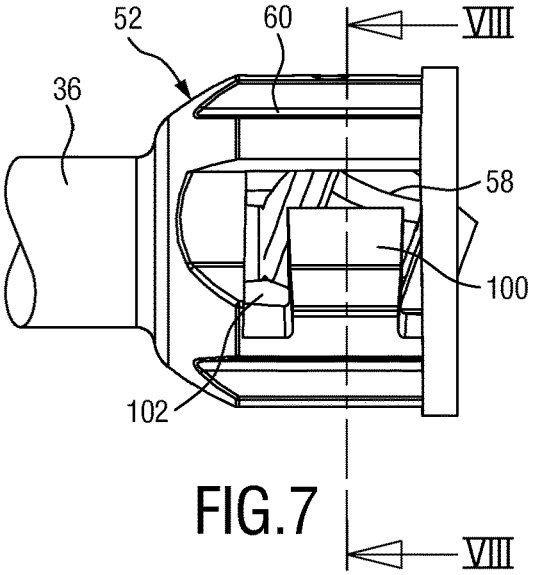
FIG. 7 is a side view of the arrangement of FIG. 6.
Figure 8:
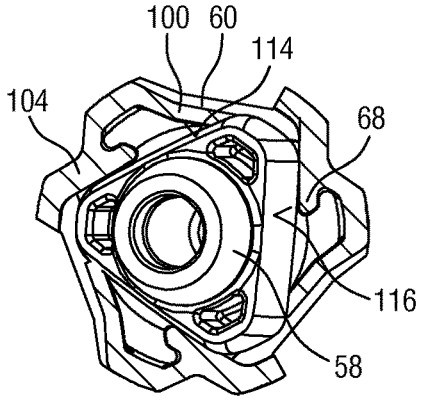
FIG. 8 is a cross-sectional rear view of the arrangement of FIG. 7 along the line VIII-VIII in FIG. 7.
Figure 9:
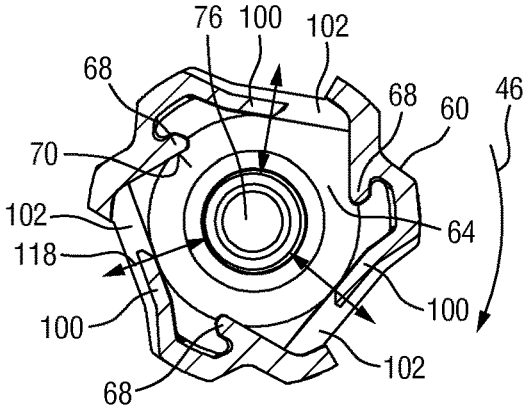
FIG. 9 is a corresponding cross-sectional rear view of a female connector of the joint section shown in FIG. 8.
Figure 10:
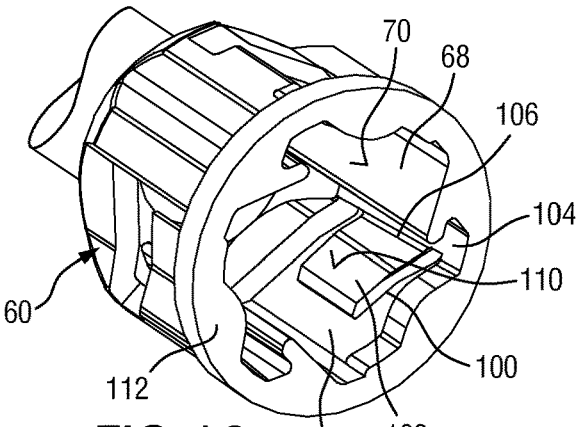
FIG. 10 is a perspective rear view of the female connector as shown in FIGS. 6 to 9.
Figure 11:
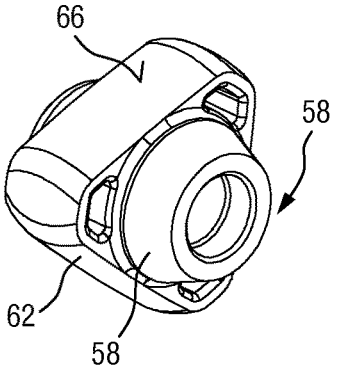
FIG. 11 is a perspective rear view of the male connector as shown in FIGS. 6 to 8.

Reference is made to FIGS. 6 to 13. FIGS. 6, 7 and 8 illustrate an engagement state of the first joint 52 wherein the male connector 58 and the female connector 60 engage one another in an angular offset fashion. Further, FIGS. 9, 10, 12 and 13 illustrate the female connector 60 in an isolated state. FIG. 11 illustrates the male connector 58 in an isolated state.

As shown in FIG. 6, the male connector 58 may engage the female connector 60 so as to drive the transmission shaft 36 to which the female connector 60 is attached. The entrainment and driving action may be achieved even when an angular offset between the male connector 58 and the female connector 60 is present, refer to FIG. 4. As indicated above, the male connector 58 is provided with an external polygonal profile 62 which is at least partially provided with convex flanks 66. Accordingly, a rotational entrainment of the female connector 60 is enabled even when a considerable angular offset is present.

FIG. 7 shows a side view of the first joint 52 wherein the male connector 58 engages the female connector 60. FIG. 8 illustrates a corresponding cross-sectional rear view along the line VIII-VIII in FIG. 7. FIG. 9 basically corresponds to the view of FIG. 8, wherein in FIG. 9 the male connector 58 has been omitted for illustrative purposes.

At the female connector 60, a plurality of compensation elements 100 is provided. The compensation elements 100 are arranged in a deflectable (flexing) fashion. Preferably, the compensation elements 100 are integrally shaped with the female connector 60. To this end, a basically circumferential wall 104 of the female connector 60 is at least partially provided with windows or recesses 102. In the windows 102, the compensation elements 100 which, so to say, form part of the circumferential wall 104, may be arranged. As can be seen in FIG. 7, only one side of the compensation element 100 is attached to a neighboring portion of the circumferential wall 104. Consequently, the compensation element 100 is, at least to some extent, flexible and deflectable. Generally, the compensation elements 100 may be arranged in a basically rectangular four-sided fashion. However, alternative embodiments may be envisaged.

As can be best seen in FIG. 9, in accordance with the embodiment of FIGS. 6 to 13, three compensation elements 100 are provided which are arranged in three corresponding recesses 102 of the female connector 60. The compensation elements 100 are radially inwardly and outwardly deflectable so as to center the male connector 58 in a preferred relative orientation with respect to the female connector 60. When the male connector 58 engages the female connector 60, the compensation elements 100 are at least slightly outwardly deflected so as to generate a biasing force. In an unbiased state, when the male connector 58 does not engage the female connector 60, the compensation elements 100, so to say, circumscribe an area which is slightly smaller that the external polygonal profile 62 of the male connector 58, particularly an axial cross-sectional profile thereof.

In FIG. 9, the rotation direction 46 is indicated by a respective curved arrow. It can be further seen that the compensation elements 100 extend in a basically circumferential fashion from the circumferential wall 104, wherein an extension direction thereof corresponds to the rotation direction 46. In the exemplary embodiment, the compensation elements 100 are angularly distributed at the circumferential wall 104 of the female connector 60, for instance at an offset angle of 120° (degrees).

Figure 12:
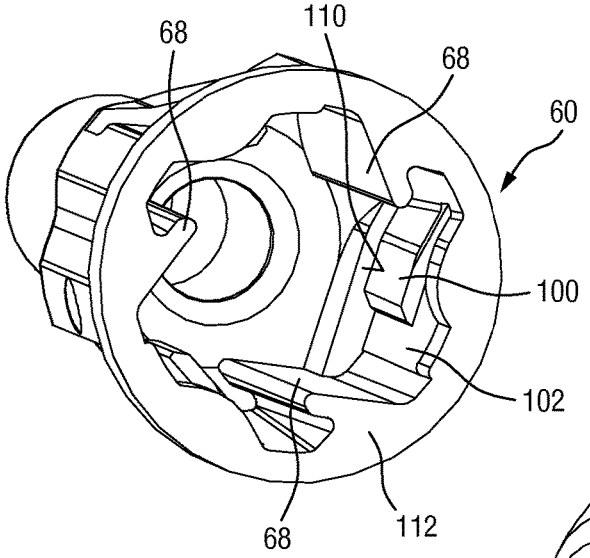
FIG. 12 is another perspective rear view of the female connector of FIG. 10 in a modified orientation.
Figure 13:
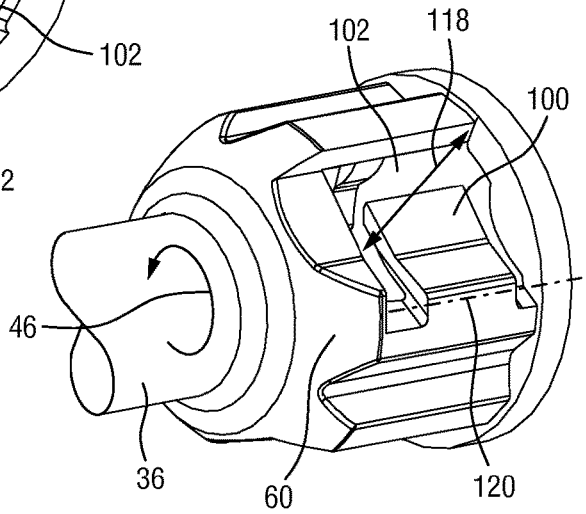
FIG. 13 is a perspective front view of the female connector as shown in FIG. 12.

Further detailed views of the compensation elements 100 are provided in FIGS. 10, 12 and 13. FIG. 11 shows a corresponding arrangement of the male connector 58 including the external polygonal profile 62 which is arranged in a triangular fashion. Needless to say, also a tetragonal shape and further alternative shapes of the corresponding external and internal profiled of the male connector 58 and the female connector 60 may be envisaged. Further, it can be seen from FIG. 11 that the external polygonal profile 62 is provided with convexly shaped flanks 66 for angular compensation purposes.

The compensation elements 100 are arranged at a defined angular offset with respect to the engagement bars 68 where the drivable flanks 70 for rotational entrainment are provided, refer also to FIG. 9. The flexing movement of the compensation elements 100 is indicated in FIG. 9 and in FIG. 13 by double arrows 118.

FIG. 10 and FIG. 12 illustrate that the female connector 60, particularly the circumferential wall 104 thereof, is arranged in a partially interrupted or recessed fashion. The compensation elements 100 are arranged in a basically deflectable and flexible fashion so as to enable a compensating inwardly-directed or outwardly-directed movement. By contrast, the engagement bars 68 are arranged in a basically rigid fashion so as to enable a basically backlash-free or backlash-reduced rotation transfer. A frontal end of the circumferential wall 104 of the female connector 60 is indicated by reference numeral 112 in FIGS. 10 and 12. Hence, in accordance with FIGS. 10, 12 and 13, the circumferential wall 104 form a cage-like structure wherein recesses or windows 102 therein which house the compensation elements 100 are surrounded by a closed profile.

As can be further seen in FIG. 10, the compensation element 100 comprises a stem portion 106 which is attached to a base provided at the wall 104. Adjacent to the stem portion 106, an arm portion 108 is provided. At the arm portion 108, a contact surface 110 is arranged which is configured for contacting a corresponding contact surface 114 formed at the external polygonal profile 62 of the male connector 58, refer also to FIG. 8. Consequently, upon exerting a biasing force on the contact surface 114, a driving surface 116 which is also formed at the external polygonal profile 62 of the male connector 58 is urged into contact with the engagement bar 68. Given the triangular shape of the external polygonal profile 62 which involves three flanks 66 that may be arranged as convexly shaped flanks, at each flank 66 a contact surface 114, and a driving surface 116 may be provided. A close contact of the driving surface 116 with the drivable flank 70 of the internal engagement profile 64 is achieved when the contact surface 110 of the compensation element 100 applies a biasing force on the counterpart contact surface 114 of the external polygonal profile 62. Operatively coupled pairs of the contact surface 114 and the driving surface 116 are not arranged at the same flank 66, but at neighboring or adjacent flanks 66.

Hence, the male connector 58 is received at the female connector 60 in a basically tight fashion with little or no (rotational) play or clearance. This improves contact conditions between the male connector 58 and the female connector 60 and allows for a smooth running of the involved joint, particularly when no or only little torque is applied to the male connector 58. As a consequence, the male connector 58 may be received at the female connector 60 in a basically self-centering or self-aligning fashion. A required quantity of lubricant may be reduced. Preferably, the male connector 58 and the female connector 60 are arranged for lubricant-free or grease-free operation. Further, a friction-reducing coating may be applied to at least one involved moving component.

The desired preloading or biasing action of the compensation elements 100 may be achieved by adequately shaping the female connector 60 in such a way that the male connector 58, particularly the external polygonal profile 62 thereof, is received in an at least slightly preloaded fashion at the internal engagement profile 64 of the female connector 60.

Further reference is made to FIG. 13 illustrating the deflection direction 118 of the compensation element 100. The compensation element 100 is arranged to flex in a defined fashion in such a way that an (imaginary) instantaneous deflection axis 120 is provided which is arranged basically parallel to the longitudinal axis 94 of the transmission shaft 36 (refer to FIG. 4). To some extent, the compensation element 100 may be arranged as a living hinge or and integrally shaped hinge so as to endure a huge number of load and position changes.

Figure 14:
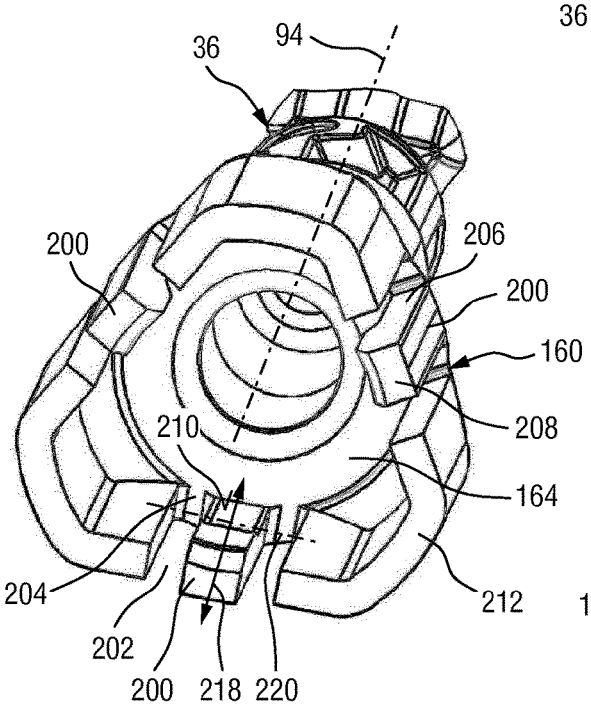
FIG. 14 is a perspective rear view of another embodiment of a female connector for a coupling linkage of a drive train.
Figure 15:
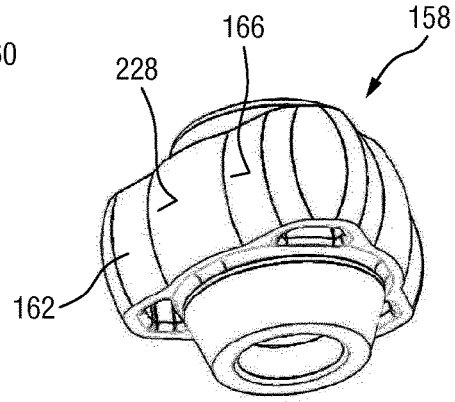
FIG. 15 is a perspective view of yet another embodiment of a male connector arranged to engage the female connector of FIG. 14.

With reference to FIGS. 14 and 15, an alternative embodiment of the first joint 52 (and/or the second joint 54) is detailed and further explained. In accordance with this embodiment, a male connector 158 (FIG. 15) and a female connector 160 (FIG. 14) is provided. As with the embodiment of FIGS. 6 to 13, also the female connector 160 is provided with compensation elements 100 which are angularly distributed along a circumferential wall 204 of the female connector 160.

For instance, three compensation elements 200 are provided which comprise a stem portion 206 and an arm portion 208 extending therefrom. However, a main extension direction of the compensation elements 200 is basically parallel to the longitudinal axis 94. In other words, the stem portion 206 of the compensation elements 200 are attached to an axial surface of a circumferential wall 204 of the female connector 160. As with the embodiment of FIGS. 6 to 13, a contact surface 210 is arranged at the arm portion 208 so as to contact the male connector 158, particularly the external polygonal profile 162 thereof.

A deflection direction of the compensation elements 200 is indicated in FIG. 14 by a double arrow 218. Consequently, an instantaneous (imaginary) deflection axis 220 may be defined which is arranged in a fashion basically perpendicular to the longitudinal axis 94. As with the embodiment of FIGS. 6 to 13, also the circumferential wall 204 of the female connector 60 in FIG. 14 is partially interrupted and/or provided with recesses 202 in which the compensation elements 200 are arranged. A frontal end 212 of the circumferential wall 204 is interrupted. Needless to say, the frontal end 212 may be alternatively formed in a continuous fashion, refer to the frontal end 112 of the embodiment of FIGS. 6 to 13.

Further reference is made to FIG. 15 illustrating an embodiment of the male connector 158 which basically corresponds to the general layout of the male connector 58 of FIG. 11. However, the male connector 158 further comprises (additional) convex protrusions 228 which are arranged at the convexly shaped flanks 166. Consequently, at the already convexly shaped flanks 166, even stronger curved protrusions 228 may be provided. The convex protrusions 228 are arranged at the external polygonal profile 162 of the male connector 158 in such a way that an engagement by the contact surfaces 210 of the compensation elements 200 is enabled.

Also with the embodiment illustrated in FIGS. 14 and 15, a self-centering and/or self-aligning of the male connector 158 and the female connector 160 may be achieved upon inserting the male connector 158 in the internal engagement profile 164 which may involve applying a snap-on mounting or click-on mounting so as to outwardly deflect the compensation elements 200, thereby generating the desired centering and/or aligning force.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A self-aligning coupling linkage of a drive train of a hair cutting appliance comprising a driving shaft and a non-aligning output shaft, said coupling linkage comprising a joint section comprising a first connector portion and a second connector portion that are arranged to engage one another for torque transmission, wherein the first connector portion defines a male connector comprising an external polygonal profile, viewed in a cross-sectional plane perpendicular to a longitudinal axis of the male connector, and the second connector portion defines a female connector comprising an internal engagement profile, wherein the male connector and the female connector are configured to be self-aligned for angular offset compensation, and wherein at least one of the male connector and the female connector is provided with at least one circumferentially arranged deflectable compensation element configured to urge the male connector and the female connector towards an operating alignment.

2. The coupling linkage as claimed in claim 1, wherein a plurality of circumferentially arranged deflectable compensation elements are configured to apply a centering compensation force to the male connector and the female connector.

3. The coupling linkage as claimed in claim 1, wherein the at least one compensation element is an integrally formed biasing element arranged at one of the male connector and the female connector.

4. The coupling linkage as claimed in claim 1, wherein the at least one compensation element comprises a stem portion extending from a base and a deflectable arm portion, and wherein the deflectable arm portion comprises a contact surface.

5. The coupling linkage as claimed in claim 4, wherein the stem portion is fixedly attached to an axial connecting wall of one of the male connector and the female connector, and wherein the deflectable arm portion is outwardly and inwardly deflectable.

6. The coupling linkage as claimed in claim 5, wherein the at least one compensation element is arranged to flex in such a way that a resulting deflection axis is perpendicular to a connector longitudinal axis.

7. The coupling linkage as claimed in claim 4, wherein the stem portion is fixedly attached to a circumferential connecting wall of one of the male connector and the female connector, wherein the deflectable arm portion is outwardly and inwardly deflectable.

8. The coupling linkage as claimed in claim 7, wherein the at least one compensation element extends in a circumferential direction from the circumferential connecting wall, wherein the circumferential direction corresponds to an operational rotation direction of the drive train.

9. The coupling linkage as claimed in claim 7, wherein the at least one compensation element is arranged to flex in such a way that a resulting deflection axis is parallel to a connector longitudinal axis.

10. The coupling linkage as claimed in claim 1, wherein the internal engagement profile of the female connector is arranged in a pattern having a partially recessed portion, wherein the at least one compensation element is arranged at a wall recess of the internal engagement profile, and wherein the at least one compensation element is arranged to contact the external polygonal profile of the male connector so as to apply an inwardly directed force on the external polygonal profile.

11. The coupling linkage as claimed in claim 1, wherein the at least one compensation element, in a mounted state, contacts a contact surface of the external polygonal profile of the male connector so as to exert a force on the male connector such that a driving surface of the external polygonal profile which is opposite or adjacent to the contact surface is urged into close contact with a corresponding mating driveable flank of the internal engagement profile of the female connector.

12. The coupling linkage as claimed in claim 1, wherein the at least one circumferentially arranged deflectable compensation element is attached to the male connector or the female connector for biasly engaging the male connector and the female connector to one another.

13. The coupling linkage of claim 12, wherein the male connector and the female connector are configured to be self-centered when engaged to one another.

14. The coupling linkage as claimed in claim 1, wherein a further joint section is provided, wherein a first joint is arranged between the driving shaft and a transmission shaft, wherein the further joint section defines a second joint arranged between the transmission shaft and the output shaft, wherein the second joint comprises a first connector portion and a second connector portion of the second joint that are arranged to engage one another for torque transmission, wherein the first connector portion and the second connector portion of the second joint define a further male connector comprising a further external polygonal profile, viewed in a cross-sectional plane perpendicular to a longitudinal axis of the further male connector, and a further female connector comprising a further internal polygonal profile, and wherein the further male connector and the further female connector are configured to be self-aligning for angular offset compensation.

15. The coupling linkage of claim 1, wherein the plurality of circumferentially arranged deflectable compensation elements includes three deflectable compensation elements.

16. A hair cutting appliance comprising:

a housing;

a cutting head attached to said housing; and a drive train comprising a driving shaft, an output shaft and a coupling linkage, wherein the coupling linkage comprises a joint section comprising a first connector portion and a second connector portion that are arranged to engage one another for torque transmission, wherein the first connector portion defines a male connector comprising an external polygonal profile, viewed in a cross-sectional plane perpendicular to a longitudinal axis of the male connector, and the second connector portion defines a female connector comprising an internal engagement profile, wherein the male connector and the female connector are configured to be self-aligned for angular offset compensation, wherein at least one of the male connector and the female connector is provided with at least one circumferentially arranged deflectable compensation element configured to urge the male connector and the female connector towards an operating alignment, wherein the cutting head comprises a blade set, and wherein the drive train is arranged to actuate the blade set when the cutting head is attached to the housing.

17. The hair cutting appliance as claimed in claim 16, further comprising a main body portion formed by the housing, and a neck portion, wherein the main body portion houses a motor, wherein the blade set is attached to the neck portion, wherein the neck portion is oriented with an angular offset with respect to a main orientation of the main body portion, wherein the main body portion houses the driving shaft, wherein the neck portion houses the output shaft, wherein a longitudinal axis of the driving shaft forms an overall offset angle ($\delta$) with a longitudinal axis of the output shaft, wherein a transmission shaft of the coupling linkage couples the driving shaft and the output shaft, wherein a longitudinal axis of the transmission shaft forms a first offset angle ($\beta$) with the longitudinal axis of the output shaft, and wherein the longitudinal axis of the transmission shaft forms a second offset angle ($\alpha$) with the longitudinal axis of the driving shaft.

18. The hair cutting appliance of claim 17, wherein the blade set is pivotably attached to the neck portion.

19. The hair cutting appliance of claim 17, wherein the overall offset angle ($\delta$) is a sum of the first offset angle ($\beta$) and the second offset angle ($\alpha$).

* * * * *